United States Patent [19]

Stoffel

[11] 4,375,298

[45] Mar. 1, 1983

[54] CINCH TYPE SEAL

[75] Inventor: John F. Stoffel, Eastchester, N.Y.

[73] Assignee: Stoffel Seals Corporation, Tuckahoe, N.Y.

[21] Appl. No.: 233,718

[22] Filed: Feb. 12, 1981

[51] Int. Cl.[3] ..... B65D 33/34

[52] U.S. Cl. ..... 292/307 R

[58] Field of Search ..... 292/307, 308, 309, 310, 292/311, 312, 313, 315, 326

[56] References Cited

U.S. PATENT DOCUMENTS

| | | | |
|---|---|---|---|
| 106,734 | 8/1870 | Small . | |
| 515,747 | 3/1894 | Carr . | |
| 796,107 | 8/1905 | Brooks . | |
| 998,879 | 7/1911 | Dinsmoor | 292/326 |
| 1,689,691 | 4/1927 | Schaefer . | |
| 1,911,060 | 5/1933 | Clark . | |
| 2,079,938 | 5/1937 | Hoornstra . | |
| 2,750,220 | 6/1956 | Keidel | 292/326 X |
| 3,326,589 | 6/1967 | Wenk, Jr. | 292/307 |
| 3,591,223 | 7/1971 | Neto | 292/320 |

FOREIGN PATENT DOCUMENTS 10688 of 1889 United Kingdom .

*Primary Examiner*—Richard E. Moore

*Attorney, Agent, or Firm*—Dowell & Dowell

[57] ABSTRACT

A cinch type seal having a cord with a loop at one end extending through a body with the ends of the cord on the side of the body remote from the loop. The body is movable relative to the cord and has a control port through which the cord is visible so that after the ends of the cord are removed, any unauthorized movement of the body relative to the cord will be visually apparent through the control port.

7 Claims, 5 Drawing Figures

Fig. 1
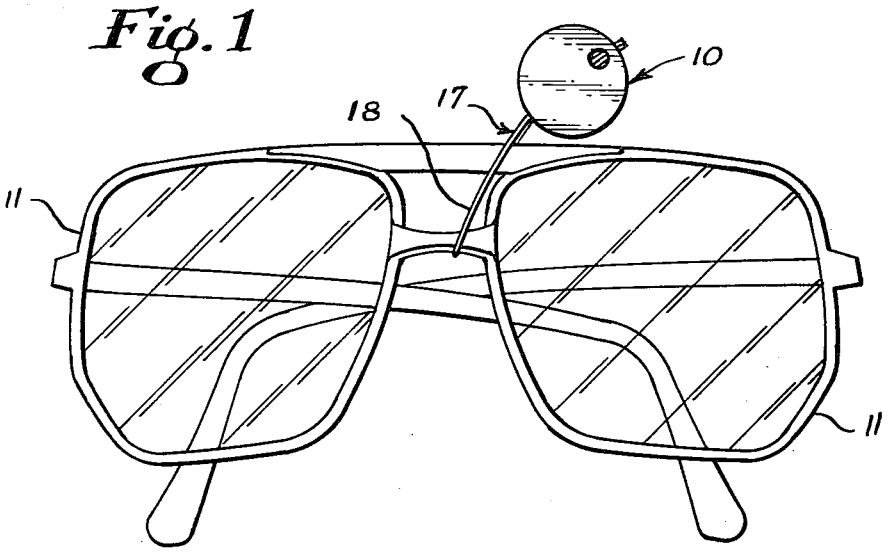
Fig. 2
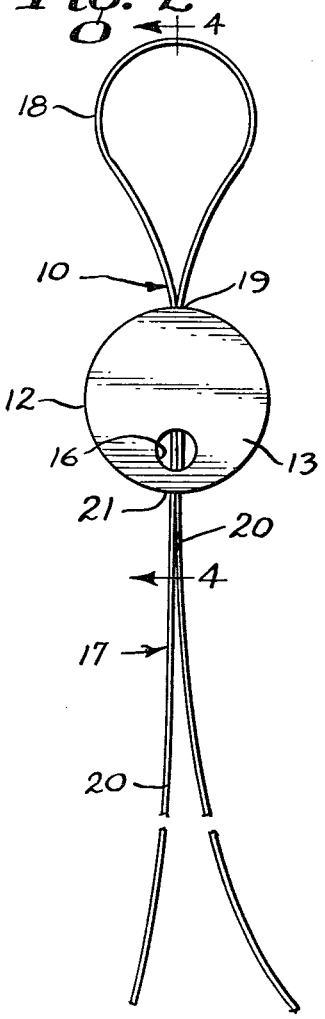
Fig. 3
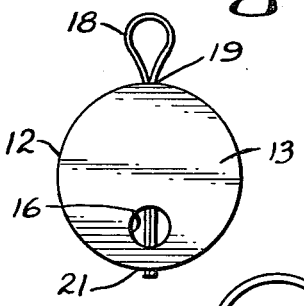
Fig. 4
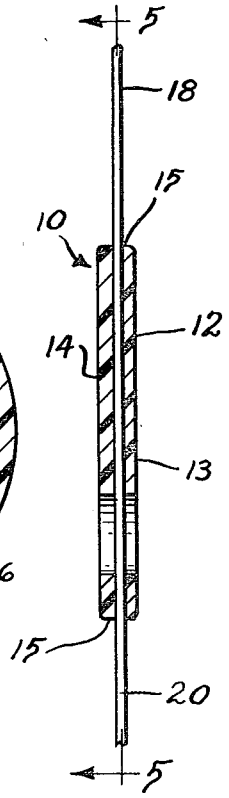
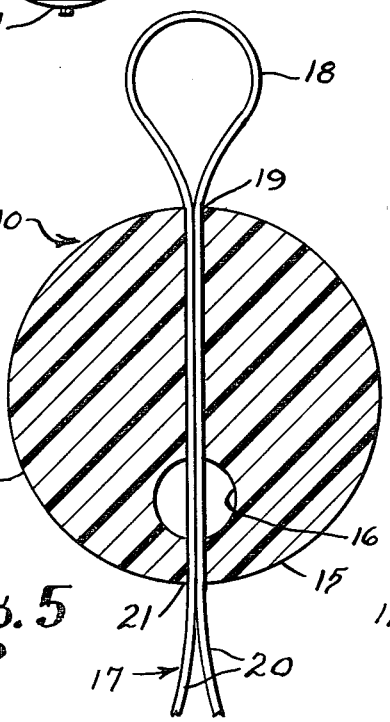
Fig. 5

CINCH TYPE SEAL

TECHNICAL FIELD

This invention relates generally to seals which discourage tampering and relates particularly to seals having a body and a cord which are movable relative to each other and in which the body has means by which movement of the cord may be detected.

BACKGROUND ART

In the past, many seals have been provided which included a body having a wire, cord or the like extending therethrough. These prior art devices normally required deformation of the seal body, as by crimping, compressing, or otherwise embedding the wire in the body by means of a hand operated die press after the wire or cord is attached to an object. In order to remove the seal, either the wire or the seal body must be destroyed. Therefore, unauthorized destruction of the seal or the cord or wire normally indicated tampering with the sealed object. Some examples of this type of seal are disclosed in U.S. Pat. Nos. 106,734 to Small; 796,107 to Brooks; 1,689,691 to Schaeffer; 1,911,060 to Clark; 3,326,589 to Wenk; and British Pat. No. 10,688, issued 1889.

In other prior art structures, such as U.S. Pat. No. 515,747 to Carr and U.S. Pat. No. 2,079,938 to Hoornstra, an elongated wire or cord is fixed at one end to the body of the seal and the other end is forced through a passageway in the body which permits one way movement only. In this manner, the cord may not be removed but must be severed or the seal destroyed in order to gain entrance to the sealed object or remove the seal from the article to which it is attached.

Still other prior art structures such as U.S. Pat. No. 3,591,223 to Neto discloses multi-part seal bodies which are forced together when the seal is applied and must be destroyed to remove the seal.

DISCLOSURE OF THE INVENTION

The present invention is embodied in a cinch type seal which includes a body that is formed on a wire or cord in such a manner that although frictioned resistance to movement is high, the body can be moved along the cord. The cord or wire is folded into two parallel interconnected segments which extend through the body and which form a closed loop on one side of the body and a pair of elongated free ends or extensions on the other side thereof. A control port or view port is located adjacent to the edge of the body from which the free ends extend. The control port extends entirely through the seal body in a direction normal to the cord so that such cord extends across such port. When the seal is to be applied, the body is moved away from the loop to enlarge the loop and then the loop is applied to an object. Thereafter, the body is moved toward the object to cinch or close the loop tight and the tails or extensions cut off or severed adjacent to the body. Since the control port is adjacent to the edge of the body where the cut ends of the cord are located, any movement of the body away from the object to loosen the loop causes the ends of the cord to move into or through the control port and gives an indication of tampering to a sales person. Further, the seal is designed and constructed so that the frictional resistance to movement between the body and the cord is great enough to insure that slippage will not occur accidentally through normal handling and use.

BRIEF DESCRIPTION OF THE DRAWING

FIG. 1 is a plan view illustrating the cinch type seal in use.

FIG. 2 is an enlarged top plan view of the seal per se.

FIG. 3 is a top plan view similar to FIG. 2 after the tails have been cut off.

FIG. 4 is an enlarged sectional view of the seal taken on the line 4—4 of FIG. 2.

FIG. 5 is a sectional view taken on the line 5—5 of FIG. 4.

BEST MODE FOR CARRYING OUT THE INVENTION

With continued reference to the drawing, a cinch type seal 10 is provided which may be attached to any desired item to be sealed including articles of merchandise such as sun glasses 11 or the like. The seal includes a body 12 which is of any desired configuration such as generally cylindrical having front and rear faces 13 and 14, respectively, and an annular side wall 15. It is noted that the body could have generally flat front and rear faces and a polygonal side wall or the body could be of generally elliptical or spherical configuration. The body 12 is also provided with an opening 16 which extends entirely therethrough. As shown, such opening 16 is located adjacent to the side wall 15.

An elongated cord or wire 17 extends through the body 12 from side to side and extends through the opening 16 so that a portion of the cord is normally visible through the opening. The cord 17 is a continuous length and is embedded within the body so that a loop 18 extends outwardly from adjacent one section 19 of the side wall 15 while the opposite ends or tails 20 of the cord extend outwardly from an opposite section 21 of the side wall 15 of the body. It should be noted that although the sections 19 and 21 of the side wall 15 are shown as being diametrically opposite each other, it is contemplated that such sections may be otherwise oriented as long as section 21 is adjacent the opening 16 in the body and the cord passes through the opening 16.

The body 12 and the cord 17 may be manufactured of any desired materials which permit relative movement but which cooperatively have a high coefficient of friction so that movement can occur only after overcoming a relatively high degree of frictional resistance. The body may be molded of a suitable thermoplastic or thermosetting material of any desired color or could be formed from a soft metal such as lead or the like. Such body may include indicia such as decorations, company identification, prices or other numbers and the like which may be molded, hot stamped in the body or attached to the body after the molding process. The cord may be of strong natural or man made fibers, plastic tapes, or ductile metal. Further, the cord may be in its natural state or may be coated with a composition to increase or decrease its cooperative restricted movable engagement with the material of the body.

INDUSTRIAL APPLICABILITY

Normally, the elongated cord 17 is folded in the middle and the body 12 is molded on such cord with a large loop 18 of the cord being formed on one side of the body and with the two strands of the cord passing through the opening 16 and extending from the opposite side of the body forming a pair of extensions or tails 20.

When the seal is to be applied, the loop 18 is placed about an article to be sealed and then the body is moved toward the article to cinch the loop tight about the article. After the body has been moved toward the article and is substantially as close as possible thereto, the tails or free ends 20 are cut off adjacent to the body by using a sharp instrument such as scissors, a knife or the like. Thereafter, any attempt at removing the seal requires that the body 12 be moved away from the article and therefore displaced with respect to the cord. Such outward movement of the body thus causes the cut ends of the cord to be pulled through the opening so that such cords are no longer visible in the opening or control port. This indicates to a sales person or other inspector that the seal has been tampered with and if the seal carries the price tag, that the article may be incorrectly marked. When it is desired to remove the seal, a strong pull on the body 12 separates the body from the cord after which the cord is easily removed from the article. Accordingly, no sharp instruments are required to remove the seal from the article.

I claim:

1. A cinch type seal comprising a body having a side wall, an elongate cord means having at least one strand movably embedded within said body and having first and second portions projecting outwardly from first and second sections, respectively, of said side wall, said body having an opening located adjacent to said second section of said side wall, said second portion having a free end, said cord means passing through said opening generally normal to the axis thereof, said cord means and body having a relatively high coefficient of friction so that they are movable relative to each other only with difficulty, whereby the first portion of said cord means which extends from said first section of said body may be attached to an article to be sealed after which said body is cinched up to the article and substantially all of said second portion of said cord means which extends from said second section of said body adjacent to said opening is removed so that movement of said body away from the article causes said free end of said cord means to pass through said opening.

2. The invention of claim 1 in which said cord means includes a pair of strands embedded within said body and said first portion of said cord means forms a loop.

3. A cinch type seal comprising a body having substantially parallel faces and a side wall, an elongated cord having a pair of strands embedded within said body and having first and second portions extending outwardly from generally opposite sides of said body, said body having an opening located adjacent to said side wall and extending entirely through said body, said first portion of said cord extending outwardly from the side of said body which is remote from said opening and defining a loop, said cord passing through said opening generally normal to the axis of said opening, said second portion of said cord defining a pair of elongated tails which extend from the side of said body adjacent said opening, said cord and said body having a relatively high coefficient of friction so that they are movable relative to each other only with difficulty, whereby said loop may be applied to an article to be sealed after which said body is moved toward the article to cinch said loop to the article and thereafter the elongated second portion of said cord are cut off adjacent to said body.

4. The method of applying a cinch type seal to an article and in which the seal has a body with an opening and cord means which extends through said body and across the opening and has a loop on one side of the body and at least one tail on the opposite side of the body comprising the steps of, placing said loop around a portion of an article to be sealed, holding said cord means while sliding said body along said cord means toward the article to cinch said loop to the article, severing said tail adjacent to said body when said loop is tight, whereby movement of said body away from the article causes the severed end of said tail to pass through said opening.

5. A cinch type seal attached to an article to be sealed comprising a body having a side wall, said body having an opening located adjacent to said side wall, cord means extending through said body and across said opening generally normal to the axis thereof, a first portion of said cord means extending outwardly of said body in a position remote from said opening, a second portion of said cord means terminating in a position contiguous to said side wall adjacent to said opening, said body and said cord means having a relatively high coefficient of friction so that relative movement between said body and said cord means is possible only with difficulty, whereby movement of said body in one direction relative to said cord means causes said second portion of said cord means to be moved relative to said opening.

6. The invention of claim 5 in which said cord means includes a pair of strands embedded within said body and said first portion of said cord means forms a loop.

7. A cinch type seal attached to an article to be sealed comprising a body having a side wall having first and second sections, cord means extending through said body, a first portion of said cord means extending outwardly of said body adjacent said first section of said side wall, a second portion of said cord means extending outwardly of said second section of said side wall and terminating contiguous thereto, said body and said cord means having a relatively high coefficient of friction so that relative movement between said body and said cord means is possible only with difficulty, whereby movement of said body in one direction relative to said cord means causes said second portion of said cord means to be moved inwardly of said body.

* * * * *